US005317037A

United States Patent [19]

Golden et al.

[11] Patent Number: 5,317,037

[45] Date of Patent: * May 31, 1994

[54] MOLDABLE COMPOSITION OF MATTER

[75] Inventors: Casey V. Golden, Evergreen; Ronald L. Turner, Golden; John A. Elverum, Elizabeth; Ray L. Hauser, Boulder, all of Colo.

[73] Assignee: Bio Dynamics, Ltd., Denver, Colo.

[ * ] Notice: The portion of the term of this patent subsequent to Sep. 10, 2008 has been disclaimed.

[21] Appl. No.: 756,470

[22] Filed: Sep. 9, 1991

Related U.S. Application Data

[63] Continuation-in-part of Ser. No. 624,849, Dec. 10, 1990, Pat. No. 5,046,730.

[51] Int. Cl.[5] ..... C08K 5/00; C08K 11/00

[52] U.S. Cl. ..... 523/128; 106/127; 106/137; 106/197.1; 106/204; 106/214; 106/217; 71/64.13; 71/903; 71/1

[58] Field of Search ..... 106/217, 127, 137, 197.1, 106/214, 204; 71/64.13, 903, 1; 523/128; 524/13, 34, 36, 47, 43, 55, 22, 56, 54

[56] References Cited

U.S. PATENT DOCUMENTS

| | | | |
|---|---|---|---|
| 3,502,458 | 3/1970 | Schenk | 71/64.13 |
| 3,884,479 | 5/1975 | Gordos | 71/64.13 |
| 3,954,263 | 5/1976 | Whelan et al. | 73/64.11 |
| 4,126,438 | 11/1978 | Pulli et al. | 71/903 |
| 5,046,730 | 9/1991 | Golden et al. | 273/33 |

*Primary Examiner*—Paul R. Michl
*Assistant Examiner*—LaVonda DeWitt
*Attorney, Agent, or Firm*—Greenlee & Winner

[57] ABSTRACT

A composition of matter comprising at least 2% by weight of a fibrous material and at least 30% by weight of a binding material such that the composition can be melt-molded into articles which have mechanical strength sufficient for their intended uses and which are biodegradable. The binding material is formed of natural substance and may also include up to 30% by weight synthetic, water-soluble polymer. The fibrous material may be cellulose and/or mineral fibers which provide the attributes of reinforcement and degradability. The composition may further include up to 20% by weight liquid or solid plasticizer which serves to lower melt viscosity and add toughness to the composite material.

16 Claims, No Drawings

MOLDABLE COMPOSITION OF MATTER

CROSS REFERENCE TO RELATED APPLICATION

This application is a continuation-in-part application of U.S. Ser. No. 07/624,849, filed Dec. 10, 1990 now U.S. Pat. No. 5,046,730.

FIELD OF THE INVENTION

This invention relates to melt-moldable compositions of matter and, more particularly, to such compositions which can be shaped into useful articles which have sufficient strength in a dry environment and which rapidly disintegrate and degrade in a wet environment.

BACKGROUND OF THE INVENTION

Many different plastic and composite materials have been used for molding useful articles. Most commercial plastics are intentionally insoluble in water and slow to biodegrade. Water-soluble plastics have been used for many years in special applications. Some natural water-soluble gums such as gum arabic, xanthan and tragacanth gums have been used in food products to give a soft consistency. Some synthetic water-soluble polymers have been used as binders and as films. Polyvinyl alcohol, polyvinylpyrrolidone, polyethylene oxide and alkyl celluloses are examples of such materials. These polymers may be fully water-soluble, but they are slow to dissolve.

Fibrous materials with a high ratio of length to diameter have been used for reinforcing composites, and the fibers are most effective if they are strong in the long direction. Mineral fibers, such as glass and asbestos, have been used for many composites, but they are not biodegradable. Natural cellulose fibers, such as fibers from wood, cotton, sisal, and linen, provide the attributes of reinforcement and degradability. Viscose rayon is a synthesized cellulose fiber that provides these same attributes. Cellulose is known to be a biodegradable material, weakened but not dissolved by water, decomposed by ultraviolet light and attacked by microorganisms in the air and soil. Cellulosic fibers are particularly susceptible to such degradation by virtue of a large surface area per volume.

Golf tees are conventionally made of wood or a moldable plastic. Tees made of such materials must be removed from the driving tee areas of golf courses, where they are often allowed to lie after the golfer has completed a drive. Tees of wood and plastic, when broken during the drive, are unsightly, are a hazard during mowing when struck by a mower blade and can damage the blades. The tees, being effectively water insoluble, must be physically picked up. Other products which are conventionally made of wood such as golf pencils and tongue depressors also present some disposal problems and thus requiring relatively short lifespans in the presence of moisture.

Efforts have been made to develop golf tees which are water soluble or degradable, and in some instances, are also beneficial to the turf. Such tees have been made of water-degradable and biodegradable materials, and often incorporate grass seed and fertilizers. A number of patents disclose such tees. U.S. Pat. No. 4,126,438, issued Nov. 21, 1978, to J. Bruno et al., discloses a disintegradable golf tee comprised of clay, grass seed and a soil conditioner, such as a fertilizer, insecticide, herbicide, fungicide, or larvacide. Humus may be added to the composition as an optional ingredient. The tee thus produced can be shattered upon impact with a club head or it can be impressed into the ground. In either event, it decomposes upon contact with moisture to impart beneficial properties to the grass and soil.

U.S. Pat. No. 4,014,541, issued Mar. 29, 1977, to A. Desmarais, discloses a golf tee composed of a water-soluble thermoplastic material having a fertilizer dispersed therein. The golf tee is produced by injection molding. U.S. Pat. No. 3,884,479 issued May 20, 1975 to A. Gordos, discloses a golf tee which will shatter or disintegrate when struck by the driver employed by the player. The golf tee has a ball support section formed of a plastic material and a shank formed from grass seed and a water soluble binder. The shank is provided with a centrally located elongated rigid reinforcing member. U.S. Pat. No. 4,909,508, issued Mar. 20, 1990, to P. Franshan et al., discloses a golf tee made from peat moss admixed with a water soluble lignosulphonate binder in an amount sufficient to bond the peat moss together in a coherent and rigid body by cold or hot pressure forming.

The principal object of the present invention is to provide a melt-moldable composition of matter which can be shaped into useful articles which are biodegradable. More specifically, it is an object of the invention to provide a composition which gives an article molded thereof a mechanical strength and rigidity sufficient for its intended use and allows said article to disintegrate and decompose after it is broken.

Another object of the present invention is to provide a composition of the foregoing character which gives an article molded thereof the look and feel of conventional wooden or plastic products. A further object of the invention is to provide an article of the foregoing character which is also competitive in strength and economics with conventional wooden and plastic products.

Still a further object of the present invention is to provide a composition which comprises readily available, non-polluting materials.

Other objects and advantages of the present invention will become apparent as the following description proceeds.

SUMMARY OF THE INVENTION

In accordance with the foregoing objects, the present invention comprises a melt-moldable composition which disintegrates in the presence of moisture and decomposes or degrades to produce components which are inert or beneficial to the ground. The composition embodying the present invention involves a binder which can be melted in the temperature range 120° C. to 175° C., and fibers of cellulosic or mineral materials. The binder is preferably formed of a natural substance selected from the group consisting of sugar (e.g., sucrose, dextrose or fructose); polydextrose; maltose; mannitol; gelatin; gluten; hydroxymethyl cellulose; gum arabic; and starch. Water-soluble, synthetic polymers such as polyvinylpyrrolidone, polyethylene oxide, polyvinyl alcohol or a hydroxyalkyl cellulose may be used together with natural binders. Chemical additives such as cross-linked sodium carboxymethyl cellulose, cross-linked poly-vinyl pyrrolidone or sodium starch glycolate may also be included in the composition to accelerate the disintegration when the products molded of such a composition become wet. The moldable composition generally comprises 30 to 98% by weight binder and 2 to 50% by weight fiber. The binder may also include up to 30% by weight synthetic, water-soluble polymer. The composition may include up to 20% by weight liquid or solid plasticizer and up to 2% by weight cross-linked additive. The components are mixed and molded into useful articles which require moderate to high dry mechanical strengths coupled with short life-spans in the presence of moisture. The compositions have sufficient structural rigidity for their intended use at normal ambient temperatures below about 50° C. These articles include golf tees, golf pencils, fertilizer spikes, slow release soil treatment spikes for, e.g., fungicides, tongue depressors, sporting clays (clay pigeons), shotgun shell wads, and the like, and may be coated with a lacquer or similar material to impart a desired surface feel and to prevent premature degradation. Thus, an article which is formed of the disclosed composition has sufficient strength and rigidity for its intended use and yet, after being used and broken, biodegrades in the presence of moisture. Biodegradation includes loss of structural integrity and decomposition of most of the components of the mixture by biological, geochemical or photochemical means, in soils, landfills or other outdoor, natural environments.

DESCRIPTION OF THE PREFERRED EMBODIMENTS

The composition embodying the present invention comprises meltable, water-soluble binders and biodegradable reinforcing fibers. The preferred binders which can be melted in the temperature range of 120° C. to 175° C. include: sugar (e.g., sucrose, dextrose or fructose); polydextrose; maltose; mannitol; gelatin; gluten; hydroxymethyl cellulose; gum arabic; and starch. The binder phase may include water-soluble synthetic polymers such as polyvinylpyrrolidone, polyethylene oxide, polyvinyl alcohol or a hydroxyalkyl cellulose. The preferred fibers include cellulosic materials from wood pulp, cotton, linen, viscose rayon and sisal materials. Peat moss, a partially decomposed wood pulp, is also a suitable reinforcing fiber. Inorganic fibers, such as wollastonite and glass fiber can also be employed.

Compositions of the present invention include from 30 to 98% by weight binder, preferably 58 to 87% by weight binder, and from 2 to 70% by weight fiber, preferably 11 to 42% by weight fiber. The compositions can include 0 to 30% by weight synthetic water-soluble polymer, preferably 1 to 12.1% by weight, as a component of the binder. The compositions can also contain 0 to 20% by weight liquid or solid plasticizer, preferably 6 to 9% by weight.

The fibers and binders are mixed together using a water solution. Alternatively, they can be pre-mixed without water, then further mixed when the binder is melted. Intimate mixing and uniform distribution of fibers is important to the efficiency of the composite system. If water is used to facilitate mixing, most of it must be cooked out of the system to provide a melt-moldable mixture.

Plasticizers of liquid or solid nature may be incorporated in the system. Propylene glycol is a useful material which serves to decrease melt viscosity and to add toughness to the composite material. Polyethylene glycol and polypropylene glycol are useful for the same function. Polyethylene oxide and polyvinylpyrrolidone add some toughness to the product as a solid polymers.

Heating the mixture not only accomplishes melting and water removal, but also appears to induce chemical reactions that serve to strengthen the final product. Accordingly, the molten composition is held at the desired temperature for ¼ hour to 2¼ hours, using longer times for larger batches to insure complete heat transfer throughout the batch. When the mixture is first blended in water, it can be heated in an oil bath to bring the mixture to a boil at about 100° C. until the water is removed. The temperature then rises to the desired range of 120° C. to 175° C., preferably 130° C. to 175° C., and most preferably about 165° C. At temperatures above about 175° C., excessive carmelization, charring and decomposition occur. When the components are dry-mixed (mixed in absence of water), the components can be melt-mixed in the desired temperature range. The latter process lends itself to continuous, rather than batch-wise, production, by first melt-mixing the components, then dispensing the molten mixture onto a continuous sheet passing through an oven at the desired temperature for the desired time. The molten product can be poured or injected into molds at once or allowed to cool and harden, broken into fragments or ground into particles as desired, then re-melted prior to being molded into the desired shape.

A chemical additive can also be included in the moldable composition to accelerate the disintegration of the product when it becomes wet. The preferred additives include cross-linked sodium carboxymethyl cellulose, cross-linked poly-vinyl pyrrolidone and sodium starch glycolate. Such an additive may be desirable in products used where biodegradation occurs in low humidity conditions, for example, arid soils.

In short, the composition of the present invention is capable of providing a wide range of applications which require moderate to high mechanical strengths coupled with relatively short life-spans in the presence of moisture.

The following examples illustrate the present invention.

Example 1

A mixture of peat moss, cooked applesauce and grass seed was prepared using approximately the following formula:

| | |
|---|---|
| peat moss | 75% by weight |
| cooked applesauce | 8% by weight |
| lawn fertilizer | 5% by weight |
| grass seed | 2% by weight |
| biodegradable water/flour | <10% by weight |

This mixture was hand-formed into the shape of a golf tee and dried in a microwave oven. The product was hard and strong, and useful as a golf tee.

Examples 2–10

The following compositions were prepared by mixing fibrous reinforcements in water solutions of the binders made of sugars, heating to dry the admixture, then injection molding into the shape of conventional golf tees. The elements of each composition are expressed in "parts by weight" was well as "percent by weight." Please note that water is excluded from the calculation of percent by weight of the elements.

| Component | Parts by Weight | Percent by Weight |
|---|---|---|
| Example 2: | | |
| Sucrose | 70 | 80 |
| Propylene Glycol | 8 | 9 |
| Wood Pulp | 10 | 11 |
| Water | 20 | |
| Example 3: | | |
| Sucrose | 60 | 60 |
| Polymer A | 9 | 9 |
| Polymer C | 2 | 2 |
| Propylene Glycol | 6 | 6 |
| Sisal Fiber | 23 | 23 |
| Water | 9 | |
| Example 4: | | |
| Sugar Solution B | 100 | 70 |
| Polymer A | 8 | 6 |
| Cotton Fiber | 35 | 24 |
| Water | 30 | |
| Example 5: | | |
| Sucrose | 62 | 52 |
| Sugar Solution B | 13 | 10 |
| Polymer A | 8 | 7 |
| Polymer C | 2 | 2 |
| Linen Fiber | 35 | 29 |
| Water | 60 | |
| Example 6: | | |
| Sucrose | 62 | 62 |
| Sugar Solution A | 13 | 13 |
| Polymer C | 2 | 2 |
| Linen Fiber | 23 | 23 |
| Water | 60 | |
| Example 7: | | |
| Sucrose | 62 | 52 |
| Sugar Solution B | 13 | 10 |
| Polymer A | 8 | 7 |
| Polymer C | 2 | 2 |
| Cotton Fiber | 35 | 29 |
| Example 8: | | |
| Sugar Solution C | 100 | 60 |
| Polymer A | 8 | 5 |
| Wood Pulp | 60 | 35 |
| Example 9: | | |
| Sucrose | 62 | 52 |
| Sugar Solution B | 13 | 10 |
| Polymer A | 8 | 7 |
| Polymer C | 2 | 2 |
| Viscose Rayon Fiber | 35 | 29 |
| Water | 80 | |
| Example 10: | | |
| Sucrose | 61.5 | 61.5 |
| Sugar Solution A | 13.4 | 13.4 |
| Polymer B | 10.5 | 10.5 |
| Polymer C | 1.6 | 1.6 |
| Wollastonite | 9.2 | 9.2 |
| Glass Fiber | 3.8 | 3.8 |

Examples 11-25

Unless indicated otherwise, the following compositions were prepared by mixing fibrous reinforcements with binders melted in the temperature range of 130° C. to 175° C. then injection molding into the shape of conventional golf tees.

| Component | Parts by Weight | Percent by Weight |
|---|---|---|
| Example 11: | | |
| Sugar Solution C | 100 | 58 |
| Polymer A | 8 | 5 |
| Polymer B | 2 | 1.5 |
| Wood Pulp | 30 | 17.5 |
| Sisal Fiber | 30 | 17.5 |
| Cross-linked Sodium Carboxymethyl Cellulose | 0.8 | 0.5 |
| Example 12: | | |
| Sugar Solution C | 100 | 59 |

-continued

| Component | Parts by Weight | Percent by Weight |
|---|---|---|
| Polymer B | 2 | 1 |
| Polymer D | 8 | 5 |
| Wood Pulp | 30 | 17.5 |
| Sisal Fiber | 30 | 17.5 |
| Example 13: | | |
| Dextrose | 100 | 73 |
| Polymer B | 2 | 1.5 |
| Gum Arabic | 5 | 3.5 |
| Sisal Fiber | 30 | 22 |
| Example 14: | | |
| Dextrose | 100 | 62 |
| Polymer B | 2 | 1 |
| Wood Pulp | 30 | 18.5 |
| Starch | 30 | 18.5 |
| Example 15: | | |
| Sugar Solution C | 100 | 59 |
| Polymer A | 8 | 5 |
| Polymer B | 2 | 1 |
| Wood Pulp | 60 | 35 |
| Example 16: | | |
| Sugar Solution C | 100 | 58 |
| Polymer A | 8 | 5 |
| Polymer B | 2 | 1 |
| Wood Pulp | 60 | 35 |
| Metalaxyl* | 3 | 2 |

*Metalaxyl is an agricultural fungicide.

The sugar solution, polymers and metalaxyl were melted and heated at 160° C. for almost one hour. The wood pulp was blended into the molten syrup mixtures and the resulting mix was baked for about one hour at 150° C. to 160° C.

| Component | Parts by Weight | Percent by Weight |
|---|---|---|
| Example 17: | | |
| Sugar Solution C | 100 | 57 |
| Polymer A | 8 | 5 |
| Polymer B | 2 | 1 |
| Wood Pulp | 60 | 34 |
| Cellulose | 1.5 | 1 |
| Metalaxyl | 3 | 2 |

Prepared as described in Example 16.

| Component | Parts by Weight | Percent by Weight |
|---|---|---|
| Example 18: | | |
| Maltose | 96 | 67 |
| Polymer A | 12.8 | 9 |
| Polymer C | 3.2 | 2 |
| Sisal Fiber | 32 | 22 |
| Example 19: | | |
| Mannitol | 96 | 67 |
| Polymer A | 12.8 | 9 |
| Polymer C | 3.2 | 2 |
| Sisal Fiber | 32 | 22 |
| Example 20: | | |
| Polydextrose | 96 | 67 |
| Polymer A | 12.8 | 9 |
| Polymer C | 3.2 | 2 |
| Sisal Fiber | 32 | 22 |
| Example 21: | | |
| Potato Starch | 96 | 67 |
| Polymer A | 12.8 | 9 |
| Polymer C | 3.2 | 2 |
| Sisal Fiber | 32 | 22 |
| Example 22: | | |
| Sugar Solution C | 100 | 59 |
| Polymer A | 8 | 5 |
| Polymer C | 2 | 1 |
| Wood Pulp, Fluff | 30 | 18 |

-continued

| Component | Parts by Weight | Percent by Weight |
|---|---|---|
| Sisal Fiber, Long | 30 | 18 |

All ingredients were mixed, then baked 1.25 hours at 165° C.

| Component | Parts by Weight | Percent by Weight |
|---|---|---|
| Example 23: | | |
| Sugar Solution C | 100 | 53 |
| Polymer A | 8 | 4 |
| Polymer C | 2 | 1 |
| Sisal Fiber, Long | 30 | 16 |
| Starch | 50 | 26 |

Prepared as described in Example 22.

| Component | Parts by Weight | Percent by Weight |
|---|---|---|
| Example 24: | | |
| Sugar Solution C | 100 | 59 |
| Polymer A | 8 | 5 |
| Polymer C | 2 | 1 |
| Wood Pulp, Fluff | 30 | 18 |
| Sisal Fiber, Long | 30 | 18 |

All ingredients were mixed, then baked 9 hours at 120° C.

| Component | Parts by Weight | Percent by Weight |
|---|---|---|
| Example 25: | | |
| Sugar Solution C | 80 | 71 |
| Cornstarch | 20 | 18 |
| Polymer A | 8 | 7 |
| Polymer C | 2 | 2 |
| Wood Pulp, Fluff | 2 | 2 |

Heated in hot oil bath at about 160° C. for about 1 hour, then baked in oven 1.25 hours at 160° C.

Characteristics of the sugar solutions in these examples, and suitable commercial products are as set forth in Table I.

TABLE I

| Sugar Solution | % Solids | % Dextrose | % Fructose | Trade Name |
|---|---|---|---|---|
| A | 75 | 19 | 2 | Karo Light Corn Syrup Best Foods, CPC Int'l. Inc. |
| B | 71 | 52 | 42 | Biosweet 42, Coors BioTec Products Company |
| C | 77 | 41 | 55 | Biosweet 55, Coors BioTech Products Company |

Characteristics of the polymers in these examples are as set forth in Table II.

TABLE II

| Polymer | Chemistry | Molecular Weight | Trade Name |
|---|---|---|---|
| A | polyvinyl-pyrrolidone | 40,000 | PVP K-30, GAF Corp. |
| B | hydroxypropyl cellulose | 95,000 | Klucel LF, Aqualon Co. |
| C | polyethylene oxide | 600,000 | Polyox WSR204, Union Carbide Corporation |
| D | polyvinyl alcohol | 31,000–50,000 | Vinol 107, Air Products Co. |

The fibrous reinforcements used in these examples have the characteristics set forth in Table III.

TABLE III

| Fiber | Chemistry | % Water | Diameter | Length | Trade Name |
|---|---|---|---|---|---|
| wollastonite | calcium silicate | — | 3–64μ | 0.3–1.0 mm | NYAD |
| sisal | cellulose | 5–12 | 32–160μ | 1–4 mm | Sisal 310, Int.'l Filler |
| linen | cellulose | 5–12 | 14–18μ' | 3–5 mm | Fibrolex 1392 Geo. Hermann |
| cotton | cellulose | 5–12 | 2–4μ | 0.5–1 mm | D260 Cotton, Int.'l Filler |
| viscose rayon | cellulose | 5–12 | 3–5μ | 2–4 mm | Rayon C-15 Vertipile Inc. |
| wood pulp | cellulose | 50 | 2–4μ | 0.3–4 mm | recycled paper Ponderosa Pulp |

The melted binder and fiber mixtures were injection molded at melt temperatures ranging from 130° to 175° C. into a mold shaped like a conventional wooden golf tee, having dimensions of 0.18 inch diameter through the shank, 2.25 inches long, and a 0.45 inch diameter head. Other configurations and dimensions may be utilized.

The molded golf tees were tested for flexural strength, compressive strength and impact strength. Flexural strength tests involved placing the shank on a span of one inch and loading the center o the span in the manner prescribed by ASTM D790-86, using a crosshead rate of 0.1 inch per minute. The maximum force was identified as flexural strength. Compressive strength was measured on some of the formulations, using a golf ball on top of a tee, with the tip constrained in an epoxy casting at the base. Maximum compressive force was measured in the manner of ASTM D-695-89, using a crosshead rate of 0.1 inch per minute. The maximum force was identified as compressive strength. Impact strength was measured using an Izod impact testing machine as described in ASTM D256-88. The tee was tested without notching, with the head one inch above the vise of the testing machine. Energy was measured in inch-pounds.

Strength of the above examples are listed in Table IV:

TABLE IV

| | Flexural, Pounds | Compression, Pounds | Impact, Inch-Pounds |
|---|---|---|---|
| Example 2 | 10.0 | 270 | 0.14 |
| Example 3 | 13.5 | 240 | 0.34 |
| Example 4 | 25.2 | — | 0.28 |
| Example 5 | 30.7 | 318 | 0.32 |
| Example 6 | 22.6 | — | 0.24 |
| Example 7 | 22.7 | — | 0.31 |
| Example 8 | 29.1 | — | 0.35 |
| Example 9 | 6.9 | 154 | 0.30 |
| Example 10 | — | 138 | 2.00 |
| Example 11 | 28.0 | 139 | 0.44 |
| Example 12 | 30.0 | 151 | 0.54 |
| Example 13 | 19.0 | 336 | 0.54 |
| Example 14 | 18.0 | 343 | 0.35 |
| Example 15 | 46.0 | 368 | 0.34 |
| Example 16 | — | — | — |
| Example 17 | — | — | — |

TABLE IV-continued

| | Flexural, Pounds | Compression, Pounds | Impact, Inch-Pounds |
|---|---|---|---|
| Example 18 | 22.0 | — | 0.5 |
| Example 19 | 18.0 | — | 0.5 |
| Example 20 | 19.0 | — | 0.5 |
| Example 21 | 24.0 | 155 | 0.5 |
| Example 22 | 27.0 | 495 | 0.47 |
| Example 23 | 20.0 | 395 | 0.38 |
| Example 24 | 46.0 | 227 | 0.44 |
| Example 25 | 14.1 | — | 0.28 |

The sugar solution of the formula representing Example 10 above was melted and 25 strands of rayon fiber, 300 denier, were pulled through the melted sugars. When the material had cooled, the impregnated and coated fibers were tested for compression and impact strength, with results as noted in Table IV.

Several of the strengths shown in Table VI compare favorably with natural wood tees having flexural strength in the range of 38 to 60 pounds, compressive strength in the range of 120 to 200 pounds, and impact strength in the range of 2.1 to 4.8 inch-pounds.

Nonetheless, formulas having relatively low flexural strengths such as those representing Examples 2, 3, 9, 19 and 20 can be used for molding products which require moderate strength including golf pencils, fertilizer spikes and tongue depressors. Of course, for applications such as golf pencils and tongue depressors, the composition must comprise elements selected from non-toxic binders and fibrous material.

Products molded of some of these formulas were placed in beakers of water and the time required for dissolving was measured. Results are shown in Table V:

TABLE V

| Example | Dissolution Time (Hours) |
|---|---|
| 2 | Less than three. |
| 3 | Less than three. |
| 4 | Less than three. |
| 5 lacquered | At 24 hours, softened, easily fragmented. |
| 6 | Less than 24. |
| 7 | Less than 24. |
| 8 | Less than 24. |
| 9 | Less than three. |
| 11 w/additive | Less than two. |

Insecticides can be added to avoid attracting ants to products. The molded products can be coated with lacquer or other moisture resistant coatings to reduce surface stickness and sensitivity to high humidity conditions. The lacquer used in example 5, Table V, was an acrylic thermplastic lacquer, one illustrative product being sold under the trade name "Krylon" spray. Other coatings which may be used to provide water barrier and non-sticky surface can include shellac, varnishes, alkyd enamels, urethane, epoxy, acrylic and optically cured coating materials. Flaky pigments such as mica and talc can be included in the coating to further decrease moisture effects on the tees prior to use. These lacquer coatings effectively retard degradation unless the molded article is broken or lies in the open for a sufficient period of time to allow photodegradation of the exterior lacquer coating to take place.

Further variations can include incorporation of blowing agents to make a dense foam which will quicken the rate of dissolution in water. Colorants can provide suitable decorative enhancement of the molded article. Swelling agents such as starch or bentonite can hasten the breakdown and the rate of dissolution, as can addition of soluble salts or fibers, e.g., potassium sulfate or ammonium sulfate. Fertilizers can also be added. Other useful compounds not inactivated by the melt temperature can be added, as desired.

A natural fibrous sugar material, such as raw sugar cane, might serve as a non-toxic raw material for this composite. Other ingredients of value may include nutshell flour, chopped or milled glass fiber and other mineral fibers.

While certain illustrative examples of the present invention have been described in detail in the specification, it should be understood that there is no intention to limit the invention to the specific form and embodiments disclosed. On the contrary, the intention is to cover all modifications, alternatives, equivalents and uses falling within the spirit and scope of the invention as expressed in the appended claims.

We claim:

1. A moldable composition of matter comprising at least 2% by weight of a fibrous material and at least 30% by weight of a natural binding material selected from the group consisting of sugar, polydextrose, maltose, mannitol, gelatin, gluten, hydroxymethyl cellulose, gum arabic, and starch such that said composition can be melt-molded into an article having mechanical strength sufficient for the intended use thereof, said article being biodegradable.

2. The composition of claim 1 wherein said sugar comprises a mixture of dextrose and fructose.

3. The composition of claim 1 wherein said fibrous material comprises a fiber selected from the group consisting of sisal, linen, cotton, viscose rayon and wood.

4. The composition of claim 1 wherein said fibrous material comprises a mineral fiber.

5. The composition of claim 1 which comprises 30 to 98% by weight binder and 2 to 50% by weight fiber.

6. The composition of claim 1 which comprises 50 to 95% by weight binder, 0 to 30% by weight synthetic water-soluble polymer, and 10 to 50% by weight fiber.

7. The composition of claim 1 which comprises 50 to 95% by weight binder, 10 to 50% by weight fiber, and 0 to 20% by weight liquid or solid plasticizer.

8. The composition of claim 1 which comprises 50 to 90% by weight binder, 0 to 20% by weight synthetic water-soluble polymer, and 0 to 20% by weight liquid or solid plasticizer.

9. The composition of claim 1 which further comprises a chemical additive whereby said additive serves to accelerate the degradation of said composition.

10. The composition of claim 1 which comprises 58 to 87% by weight binder and 11 to 42% by weight fiber.

11. The composition of claim 10 which further comprises 1 to 12.1% by weight synthetic, water-soluble polymer as a component of the binder.

12. The composition of claim 10 which further comprises 1 to 12.1% by weight synthetic, water-soluble polymer as a component of the binder and 6 to 9% by weight liquid or solid plasticizer.

13. The composition of claim 1 which includes a grass treatment adjuvant.

14. The composition of claim 1 which includes a swelling agent.

15. A golf tee molded of the composition as defined in claim 1.

16. A soil treatment spike molded of the composition as defined in claim 1.

* * * * *